United States Patent [19]

Espy

[11] 4,022,586

[45] May 10, 1977

[54] AUSTENITIC CHROMIUM-NICKEL-COPPER STAINLESS STEEL AND ARTICLES

[75] Inventor: Ronald Harry Espy, Randallstown, Md.

[73] Assignee: Armco Steel Corporation, Middletown, Ohio

[22] Filed: May 12, 1975

[21] Appl. No.: 576,367

Related U.S. Application Data

[63] Continuation-in-part of Ser. No. 888,165, Dec. 29, 1969, abandoned, which is a continuation of Ser. No. 580,201, Sept. 19, 1966, abandoned.

[52] U.S. Cl. ..... 75/125; 75/126 A; 75/126 G; 75/126 R; 148/38

[51] Int. Cl.[2] ..... C22C 38/20; C22C 38/26; C22C 38/28

[58] Field of Search ..... 75/125, 128 G, 128 T, 75/128 A; 29/196.1; 148/38

[56] References Cited

UNITED STATES PATENTS

| | | | |
|---|---|---|---|
| 2,447,897 | 8/1948 | Clarke, Jr. | 75/125 |
| 2,468,808 | 5/1949 | Drake | 219/10 |
| 2,540,509 | 2/1951 | Clark, Jr. | 75/125 |
| 2,775,519 | 12/1956 | Bloom et al. | 148/38 |
| 2,784,125 | 3/1957 | Clarke, Jr. | 75/128 G |
| 2,824,796 | 2/1958 | Eberle et al. | 148/38 |
| 2,850,380 | 9/1958 | Clarke, Jr. | 148/38 |
| 3,282,686 | 11/1966 | Allen | 75/125 |
| 3,303,023 | 2/1967 | Dullis et al. | 75/125 |

OTHER PUBLICATIONS

Welding Handbook, 4th ed. sec. 4, pp. 65.4–65.9, AWS, N.Y. (1960).

*Primary Examiner*—Arthur J. Steiner
*Attorney, Agent, or Firm*—John Howard Joynt

[57] ABSTRACT

Weldable austenitic chromium-nickel-copper stainless steel of low work-hardening rate and welded products fashioned thereof which are free of incipient cracking near and adjacent the weld upon cooling from welding temperatures. Such steel and products contain about 12 to 25% chromium, about 6 to 20% nickel, about 0.10 to 15% manganese, about 2.5 to 4% copper, about 0.01 to 0.07% carbon, with columbium-tantalum in the amount of at least 0.10% but no more than 0.5% and/or titanium in the amount of at least 0.1% but no more than .25%. The remainder of the composition is substantially all iron.

9 Claims, No Drawings

AUSTENITIC CHROMIUM-NICKEL-COPPER STAINLESS STEEL AND ARTICLES

CROSS-REFERENCE TO RELATED APPLICATIONS

This application for patent is a continuation-in-part of Ser. No. 888,165, filed Dec. 29, 1969, entitled Arc-Weld Method and Articles, which application in turn is a continuation of the then pending application, Ser. No. 580,201, filed Sept. 19, 1966 and entitled Austenitic Chromium-Nickel-Copper Stainless Steel of Good Weldability, both of which are now abandoned.

SUMMARY OF THE INVENTION

My invention relates to the austenitic chromium-nickel-copper stainless steels, more particularly to the austenitic chromium-nickel-copper stainless steels of low work-hardening rate, and generally may be considered to reside in such steels wherein good welding characteristics are realized by virtue of a critical addition of one or more of columbium-tantalum and titanium.

One of the objects of my invention is the provision of an austenitic chromium-nickel-copper stainless steel which readily lends itself to welding by any of the electric arc techniques as in the fabrication of a variety of articles, equipment, apparatus, and the like, comprising such steel.

Another object is the provision of austenitic chromium-nickel-copper stainless steel plate, sheet, strip, bars, rods, wire, special shapes, and like hot-rolled and/or cold-rolled mill products of low work-hardening rate and minimum cost, which are not subject to any substantial hardening by heat-treatment, either transformation-hardening (quenching from high temperature) or by precipitation-hardening (either single or double reheating from a solution-treated condition), which products readily lend themselves to various forming operations, such as pressing, bending, spinning, drawing, deep-drawing, cold-heading and the like, as well as such machining operations as shearing, sawing, drilling threading, and the like, and welding by the electric arc, either prior to or subsequent to forming and machining, as in the fabrication of a variety of articles, equipment and apparatus comprising such products.

A further object is the provision of such steel mill products and various welded articles, equipment and apparatus of ultimate using comprising such steel and products, and a method of assuring sound, strong welded products, sound and strong in the weld and in the metal near and adjacent the weld, when welded by any of the known and commonly used welding techniques, including the tungsten arc with inert gas protective atmosphere.

Other objects of my invention, and various advantages and benefits thereof, will be apparent from or particularly pointed to in the description which follows.

Accordingly, my invention will be seen to reside in the combination and correlation of alloying ingredients of the steel, and the products fashioned thereof, in the fabricated welded articles, equipment and apparatus comprising such steel and products, and in the method of assuring strength in such welded steel products and articles, all as more particularly described below and especially set forth in the claims at the end of this specification.

In order to better understand certain features of my invention it may be well to note at this point that the austenitic chromium-nickel-copper stainless steels, including those in which maganese is partially or largely substituted for nickel, are finding wide favor in the arts. Typically, these are the chromium-nickel-copper stainless steels described in the Bloom-Clarke U.S. Pat. Nos. 2,687,955 of Aug. 31, 1954, and 2,775,519 and 2,775,520, both of Dec. 25, 1956. These steels contain carbon in amounts up to 0.15%, and it is said that carbon may be stabilized, where desired, by including columbium or titanium in the usual amounts, say illustratively a minimum of 8 × carbon for the one, and 4 × carbon minimum for the other.

Although the steels of the three patents are characterized by a rather low work-hardening rate, the welding characteristics, especially the properties of strength and toughness following a welding operation, as more fully dealt with below, leave much to be desired. In some instances cracking near and adjacent the weld has been noted; freedom from incipient cracking is not positively assured when certain of the commonly used welding techniques are employed, unless special considerations are resorted to during the welding operation.

While others of the austenitic chromium-nickel-copper stainless steels do, indeed, enjoy low work-hardening properties, and at low cost in the ingot and in the mill products such as plate, sheet, strip, bars, rods, wire, and special shapes, those steels, too, are lacking in an assured strength and freedom from incipient cracking following welding by the well-known and widely used tungsten arc-inert atmosphere technique, as also more fully described below. I refer to the steels described in the companion co-pending Allen Applications Ser. No. 299,110 filed July 31, 1963, now U.S. Pat. No. 3,282,684, and Ser. No. 429,656 filed Feb. 1, 1965, now U.S. Pat. No. 3,282,686, both of Nov. 1, 1966.

Additionally, there is a precipitation-hardenable chromium-nickel-copper stainless steel Armco 17-4 PH (about 15.5% to 17.5% chromium, 3.0 to 5.0% nickel, 3.0 to 5.0% copper, 0.97% maximum carbon, 0.15 to 0.45% columbium-tantalum, and remainder iron). This steel, although weldable, is of such composition balance that it is martensitic. And there is the high-molybdenum Armco 17–14 Cu-Mo stainless steel (about 15.9% chromium, 14.1% nickel, 3.0% copper, 2.5% molybdenum, 0.12% carbon, .45% columbium, .25% titanium, and remainder iron). This steel, forming the subject of the Clarke U.S. Pat. No. 2,540,509, also is precipitation-hardenable. Molybdenum is an ingredient essential to the steel. It is thought that in that critically balanced steel the copper, columbium and titanium serve to effect the precipitation-hardening reaction, the copper possibly appearing in finely dispersed form and the columbium and titanium appearing as carbides.

Among the objects of my invention, therefore, is the provision of an austenitic chromium-nickel-copper stainless steel, especially one of low work-hardening rate, which is not substantially hardenable by heat-treatment, that is, not substantially hardenable either by transformation-hardening treatment or by precipitation-hardening heat-treatment, and the production of various hot-rolled as well as cold-rolled or cold-drawn mill products thereof, as well as the provision of welded articles and method comprising such steel and products in which soundness, strength, toughness and freedom from incipient cracking is assured irrespective of the particular welding technique employed.

DESCRIPTION OF THE PREFERRED EMBODIMENTS

Referring now more especially to the practice of my invention, I provide an austenitic chromium-nickel-copper stainless steel, especially such a steel of low work-hardening rate, and at minimum cost. My steel essentially consists of about 12% to 25% chromium, about 6% to 20% nickel, up to about 2% manganese, although where desired the manganese content may range from about 0.10% to 15%, about 2.5% to 4% copper, about 0.07% carbon, although, again where desired the carbon content may range from about 0.01% to 0.07%, at least .10% but not more than 0.5% columbium-tantalum, and remainder substantially all iron. In general, for reasons more particularly dealt with hereinafter, the columbium-tantalum content is further restricted, this to an amount less than 8 times the carbon content. Where desired, as noted more fully below, in place and stead of columbium-tantalum there may be employed titanium, this in the amount of at least .1% but not more than 0.25%. Similarly, the titanium content ordinarily is further restricted to an amount less than 4 times the carbon content. It is the columbium-tantalum addition, however, in which all of the desired properties of the steel are had.

More particularly then, the austenitic steel of my invention essentially consists of about 12% to about 25% chromium, about 6% to about 20% nickel, about .10% to 15% manganese, about 2.5% to about 4% copper, about 0.01% to 0.07% carbon, at least one of the group consisting of at least .10% but no more than 0.5% columbium-tantalum, with columbium-tantalum further restricted to less than 8 times the carbon content, and at least .1% but not more than 0.25% titanium, with further restriction to less than 4 times the carbon content, and remainder substantially all iron.

Perhaps the steel which best achieves all of the desired properties, that is, a combination of workability, formability, weldability, strength, toughness, ductility, and corrosion resistance at minimum cost, is realized in the austenitic stainless steel essentially consisting of about 17 to 19% chromium, about 8 to 10% nickel, up to about 2% manganese, about 3 to 4% copper, with carbon in the amount of 0.01 to .07%, columbium-tantalum in the amount of at least .10% but not more than 0.5%, and preferably 0.2 to .5% with further restriction to less than 8 times the carbon content, with remainder substantially all iron. Where desired, as for example a slight saving in cost, there may be employed titanium in the amount of about 0.1 to 0.25% in substitution for columbium-tantalum in this steel, with further restriction of titanium to less than 4 times the carbon content. While the compositions noted with, however, carbon about 0.02 to 0.07%, are particularly suited to sheet and strip, for products such as plate, bar, and wire, a best combination of properties is had with a carbon content of about 0.01 to about 0.04%, and columbium-tantalum about 0.1 to about 0.3%, or titanium, where used, about 0.1%.

A further more specific example of the steel of my invention essentially consists of about 18% chromium, about 9% nickel, up to about 2% manganese, about 3% copper, carbon about 0.01 up to about 0.07%, columbium-tantalum in the amount of at least 0.1% but no more than 0.5% and less than 8 times the carbon content, and remainder substantially all iron.

While the chromium, nickel and the manganese contents of the steel of my invention are rather broadly set, the copper, the carbon, the columbium-tantalum and/or the titanium content are viewed as critical. For I find that where one of more of copper, carbon, columbium-tantalum and/or titanium significantly depart from the upper and lower limits set out above, one or more of the desired properties of the steel are lost; it is in the combination of the ingredients, correlated as to the respective percentage ranges, which gives steel and products of the desired properties.

In my steel the chromium content amounts to about 12% to 25%. Chromium in lesser amount than about 12% fails to impart the desired corrosion-resisting properties, while chromium in amount exceeding about 25% generally results in the formation of a sigma phase with resulting difficulties in converting the metal from ingot into various hot-rolled products. Nickel is in the amount of about 6 to 20%, for with a nickel content less than about 6% the desired austenitic balance directly suffers, while with nickel exceeding about 20% the cost not only becomes prohibitive, but the mechanical properties are inclined to suffer. Although the manganese content may range from about 0.10 to 15%, the manganese serving as a partial substitute for nickel, I prefer that the manganese shall not exceed about 2% because of a loss in corrosion-resistance suffered with the higher manganese contents. Manganese exceeding about 15% is not desired because of the high loss of manganese in melting the steel and undue loss of corrosion-resistance. The silicon content usually is in amounts up to about 1%, the silicon being added during melting to serve as a deoxidizer. An excess of silicon, because of its ferrite-forming tendencies and the inclination to develop a sigma phase, generally is not desirable. Under some circumstances a higher silicon content may be employed but this requires additional nickel, at further cost, to maintain the austenitic balance. Phosphorus and sulphur, of course, commonly are present as impurities, both being less than about 0.030%, however, the phosphorus typically being on the order of 0.020% and less and the sulphur on the order of 0.015% and less.

As noted above, however, it is the ingredients copper, carbon and columbium-tantalum, as well as titanium where employed, which are especially critical to the steel of my invention, columbium-tantalum or titanium being particularly critical. I find that in the austenitic chromium-nickel-copper stainless steels, as in the form of sheet, strip, plate, bars, rods, wire, special shapes and the like, a serious problem is introduced where the steel is welded by the well-known tungsten arc-inert gas atmosphere technique. Although the weld metal itself is found to be strong, tough and ductile, yet the base metal back and away from the weld is fraught with minute cracks and microfissures. Strangely enough, these defects appear largely on the surface of the metal.

While I do not care to be bound by explanation, it is my view that in welding with the tungsten arc an intense heat is developed, this serving to vaporize a significant portion of the copper present in the steel of the weld. And that the copper vapor under the action of the protective inert gaseous atmosphere employed in the welding operation is blown about and condenses out as molten copper on the surface of the steel. Condensation occurs within the region adjacent the weld where the temperature of the metal is on the order of some 2600° F, back a ways but near the weld where the temperature is more nearly on the order of 1900° F. These are the approximate temperatures defining the range of the liquid state of elemental copper. It is within the region noted that the copper appears on the surface in liquid form. Further away and at lower temperatures any copper appears as a solid rather than a liquid. It is my view that the liquid copper penetrates the grain boundaries of the austenitic steel, apparently forming with something which exists in the grain boundaries, a constituent of low melting point which weakens the phase and permits separation under stress. In any event, however, and irrespective of theory, I find that upon welding the austenitic chromium-nickel-copper stainless steels and with the cooling and shrinking of the weld there develop stresses in the base metal which develop and/or open cracks at the grain boundaries within the area near and adjacent the weld. While, as suggested above, this largely is a surface effect, there is suffered a loss of strength as well as damage to the surface itself.

In accordance with the teachings of my invention, I essentially employ in the austenitic chromium-nickel-copper stainless steels a small but critical amount of columbium-tantalum, or even a small but critical amount of titanium. The resulting austenitic chromium-nickel-copper stainless steels are characterized by a freedom from cracking and microfissuring near and adjacent the weld irrespective of the welding technique employed. Apparently with proper control of the copper and carbon contents of the steel and the necessary columbium-tantalum addition in critical amount, or the addition of titanium in critical amount as noted, the character of the grain boundary constituent is radically changed. In any event and irrespective of theory, I find that the columbium-tantalum-bearing austenitic chromium-nickel-copper stainless steel of my invention and the titanium-bearing steel are free of cracking following conventional welding by way of the tungsten to arc-inert gas technique.

The copper content of my steel ranges from about 2.5% to 4%, as noted above. With a copper content substantially less than about 2.5% there seems to be little or no tendency toward incipient cracking near and adjacent the weld, following the commonly used tungsten arc-inert atmosphere technique. A copper content in excess of 4%, however, it is not acceptable because the excess appears as free copper with a resultant hot-shortness and loss of hot-working properties.

And in the steel of my invention carbon is in the amount of about 0.01 to 0.07%. A carbon content less than 0.01% is not readily attained. But in addition to that circumstance, the small amount of carbon is viewed to be beneficial as an austenite former, and, moreover, it assures a cleaner steel. Carbon in excess of 0.07% is not desired because of a definite loss in corrosion-resisting properties and because of the development of an undesired sensitized zone when the metal is welded, this with loss of strength and toughness, unless substantially increased quantities of columbium-tantalum or titanium are employed for the purpose of carbon stabilization, this at increased cost and sacrifice of properties as noted below. It is the lower carbon contents which are desired.

The amount of the ingredient columbium-tantalum likewise is highly critical. Under certain circumstances, as indicated above, titanium may be employed in the place and stead of columbium. But this is not generally desirable because titanium is inclined to the development of dirty metal. Columbium-tantalum gives a cleaner steel with less inclination to the formation of clusters of nonmetallics which detract from cold-forming properties. Columbium-tantalum where employed is in the amount of 0.10% to not more than 0.5%. At least 0.10% columbium-tantalum is necessary to the realization of the desired welding properties, the same being true where it is titanium rather than columbium-tantalum which is employed. Columbium-tantalum is substantially higher amounts not only is unnecessarily costly, but because columbium is found to be a strong ferrite former it results in a disturbance of the austenite balance unless additional nickel is employed to restore the balance, this, of course, at an undesired increase in cost. Moreover, it appears that with excessive columbium there is the possiblity of hot-short cracking in the heat-affected zone and, indeed, strain-age cracking in that zone following a welding operation. Where titanium is employed, instead of columbium-tantalum, titanium exceeding .25% may increase the risk of the developing dirty metal, with its accompanying adverse effect upon mechanical properties.

In melting the steel of my invention to specification there conveniently is employed an electric arc furnace. It is to be understood, however, that where desired the steel may be induction vacuum-melted or otherwise melted to specification. Irrespective of the manner of melting, however, the steel handles well both in the furnace and in the ladle. And in the form of ingots is readily converted into slabs, blooms and billets. Upon reheating it is readily hot-rolled as in the production of plate, sheet, strip, bars, rods, wire, and the like. It works well in the mill.

Sheet and strip coming off the hot-mill conveniently is coiled. And following annealing and/or pickling it is cold-worked to required specification. The hot-rolled wire as coiled is annealed and pickled, or merely pickled, and then cold-drawn as desired.

As more particularly illustrative of the the steel of my invention I give below, in Table I, the chemical analyses of two of the columbium-bearing austenitic chromium-nickel-copper stainless steels and one of the titanium-bearing steels, these as compared to the analysis of an austenitic chromium-nickel-copper stainless steel of the prior art which is free of both of columbium-tantalum and titanium, the steel of the prior art being marked with an asterisk:

Table I

| Heat No. | C | Mn | P | S | Si | Cr | Ni | Cu | Cb | Ti |
|---|---|---|---|---|---|---|---|---|---|---|
| 50309* | .056 | .66 | .020 | .014 | .49 | 17.36 | 8.57 | 3.12 | — | — |
| 5021 | .057 | .83 | .021 | .011 | .58 | 17.48 | 8.63 | 3.03 | .37 | — |
| 5300 | .046 | .63 | .009 | .011 | .45 | 17.40 | 8.48 | 2.66 | .18 | — |
| 5301 | .056 | .75 | .010 | .010 | .47 | 17.61 | 7.98 | 2.73 | — | .12 |

*steel of prior art

While I find that the steel of the prior art, Heat 50309, when welded by the gas-tungsten-arc process, developed cracks near and adjacent the weld, the two columbium-bearing steels of my invention, as well as the one titanium-bearing steel, are free of such cracks.

Thus it will be seen that I provide in my invention an austenitic chromium-nickel-copper stainless steel in which the objects hereinbefore set forth are fully realized. The steel is possessed of a desired combination of good corrosive-resistance and weldability by way of well-known and commonly used welding techinques, including that of the tungsten-arc with inert gas atmosphere, this including those steels of low work-hardening rate.

The austenitic steel, and the plate, sheet, strip, bars, rods, wire, special shapes, and the like thereof, conveniently is supplied the trade in the annealed and pickled, or in the bright-annealed, condition. These products lend themselves to fabrication as by pressing, bending, spinning, drawing, deep-drawing and other forming operations, and by shearing, sawing, drilling, threading and the like. As well, they readily lend themselves to welding by any of the known and commonly practiced techniques, including the gas-tungsten-arc process, as in the production of a variety of articles of ultimate use, equipment and apparatus.

Inasmuch as many embodiments of my invention will occur to those skilled in the art to which the invention relates, and since many variations will occur respecting the embodiments herein disclosed, it is to be understood that all matter described herein is merely illustrative, and is not to be taken as a limitation.

I claim:

1. Austenitic stainless steel having a work-hardening rate lower than the conventional austenitic chromium-nickel stainless steel and upon cooling after having been welded by the electric arc in the presence of an inert gas characterized by freedom from incipient cracking in the heat-affected zone, said steel consisting of about 17 to about 19% chromium, about 8 to about 10% nickel, about 3 to about4% copper, up to about 2% manganese, about 0.01 to about 0.07% carbon, at least one ingredient selected from the group consisting of at least 0.10% but not more than 0.5% columbium-tantalum, with the columbium-tantalum content being less than 8 times the carbon content, and at least 0.10 but not more than 0.25% titanium, with the titanium content being less than 4 times the carbon content, and remainder iron.

2. Austenitic stainless steel having a work-hardening rate lower than the conventional chromium-nickel stainless steel and upon cooling after having been welded by the electric arc in the presence of an inert gas characterized by freedom from incipient cracking in the heat-affected zone, said steel consisting of about 17 to about 19% chromium, about 8 to about 10% nickel, about 3 to about 4% copper, up to about 2% manganese, about 0.01 to about 0.07% carbon, at least 0.1% but not more than 0.5% columbium-tantalum, with the columbium-tantalum content being less than 8 times the carbon content, and remainder iron.

3. Austenitic stainless steel sheet and strip consisting of about 17 to about 19% chromium, about 8 to about 10% nickel, about 3 to about 4% copper, up to about 2% manganese, about 0.02 to about 0.07% carbon, at least one ingredient selected from the group consisting of at least 0.10% but not more than 0.5% columbium-tantalum and at least .1% titanium, with the one further restricted to less than 8 times the carbon content and the other to less than 4 times carbon content, and remainder iron.

4. Austenitic stainless steel plate, bar and wire consisting of about 17 to about 19% chromium, about 8 to about 10% nickel, about 3 to about 4% copper, up to about 2% manganese, about 0.01 to about 0.04% carbon, at least one ingredient selected from the group consisting of at least 0.10% but not more than 0.3% columbium-tantalum and at least 0.1% titanium, with one further restricted to less than 8 times the carbon content and the other to less than 4 times carbon content, and remainder iron.

5. Austenitic stainless steel consisting of about 18% chromium, about 9% nickel, up to about 2% manganese, about 3% copper, carbon about 0.01 to about 0.07%, columbium-tantalum in the amount of at least 0.1% but no more than 0.5% and less than 8 times the carbon content, and remainder iron.

6. Austenitic stainless steel consisting of about 17.5% chromium, about 9% nickel, about 3% copper, about 0.06% carbon, about 0.4% columbium, and remainder iron.

7. Austenitic stainless steel consisting of about 17.5% chromium, about 8% nickel, about 3% copper, about 0.05% carbon, about 0.2% columbium, and remainder iron.

8. Austenitic stainless steel consisting of about 17.5% chromium, about 8% nickel, about 3% copper, about 0.06% carbon, about 0.1% titanium, and remainder iron.

9. Arc-welded article comprising welded austenitic chromium-nickel-copper stainless steel, said steel having a work-hardening rate lower than the conventional austenitic chromium-nickel stainless steel and which steel upon cooling after having been welded by the electric arc in the presence of an inert gas is free of incipient cracking in the heat-affected zone of the welded steel, said steel consiting of about 17% to 19% chromium, about 8% to 10% nickel, up to about 2% manganese, about 3% to 4% copper, about 0.01% to 0.07% carbon, at least .10% but not more than 0.5% columbium-tantalum, and the remainder iron, with the columbium-tantalum being less than 8 times the carbon content.

* * * * *